US011113915B1

(12) United States Patent
Ogram

(10) Patent No.: US 11,113,915 B1
(45) Date of Patent: Sep. 7, 2021

(54) VOTE COUNTING STATION

(71) Applicant: Mark Ellery Ogram, Tucson, AZ (US)

(72) Inventor: Mark Ellery Ogram, Tucson, AZ (US)

( * ) Notice: Subject to any disclaimer, the term of this patent is extended or adjusted under 35 U.S.C. 154(b) by 0 days.

(21) Appl. No.: 16/974,204

(22) Filed: Nov. 13, 2020

(51) Int. Cl.
*G07C 13/00* (2006.01)
*H04H 60/33* (2008.01)

(52) U.S. Cl.
CPC ..... *G07C 13/00* (2013.01); *H04H 60/33* (2013.01)

(58) Field of Classification Search
CPC ..... G07C 13/00; H04H 60/33
USPC ..... 235/386
See application file for complete search history.

(56) References Cited

U.S. PATENT DOCUMENTS 6,992,722 B2 * 1/2006 Jung ..... H04N 5/2252 348/373
7,178,730 B1 * 2/2007 Jamison ..... G07C 13/00 235/386
7,828,215 B2 * 11/2010 Chung ..... G07C 13/00 235/454
7,905,448 B2 * 3/2011 Sjunnesson ..... F01D 25/28 244/54
8,556,161 B2 * 10/2013 Djoudi ..... G07C 13/00 235/50 B
8,985,299 B2 * 3/2015 Liao ..... B65H 5/002 194/218
9,039,157 B2 * 5/2015 Ogata ..... B41J 2/07 347/95
9,070,079 B2 * 6/2015 Iwahara ..... G06K 15/1803
9,544,473 B2 * 1/2017 Namihira ..... H04N 1/00312
9,589,260 B2 * 3/2017 Choi ..... G06Q 20/20
9,965,919 B2 * 5/2018 Oh ..... G06Q 50/34
10,334,129 B2 * 6/2019 Younis ..... H04N 1/00575
10,353,495 B2 * 7/2019 Nemala ..... G06F 3/167
10,623,703 B2 * 4/2020 Pettersen ..... H04N 5/23296
10,755,811 B2 * 8/2020 Bernard ..... G01T 1/247
10,773,533 B1 * 9/2020 Inokuchi ..... B41J 2/32
10,810,684 B1 * 10/2020 Krakowiecki ..... G06Q 40/025
10,817,698 B2 * 10/2020 Shi ..... G02F 1/13338
10,824,372 B2 * 11/2020 Zhang ..... G06F 11/1469
10,824,855 B1 * 11/2020 Sachtleben ..... G06Q 20/3276
10,825,048 B2 * 11/2020 Mazur ..... G06F 16/5866
10,826,787 B2 * 11/2020 Soundararajan ..... H04L 41/145
2008/0142594 A1 * 6/2008 Haas ..... B65D 27/12 235/454
2014/0263638 A1 * 9/2014 Bolton ..... G07C 13/00 235/386
2017/0061722 A1 * 3/2017 Malatesta ..... G07C 13/00
2018/0211466 A1 * 7/2018 Cheng Chuah ..... B42D 25/305
2019/0051079 A1 * 2/2019 Venkataraman ..... H04L 9/3239

* cited by examiner

*Primary Examiner* — Daniel A Hess
(74) *Attorney, Agent, or Firm* — Mark Ogram

(57) ABSTRACT

The invention provides for a system for processing tendered ballots. A table for a poll worker is provided on which the ballots are sorted and processed. A camera is directed to the work space on the table. The image from the camera is both digitally stored and provided to the poll watchers via a viewing screen. The poll worker then knows that his actions are being monitored and recorded, thereby reducing thoughts of trying to "fix" the vote.

11 Claims, 2 Drawing Sheets

VOTE COUNTING STATION

BACKGROUND OF THE INVENTION

This invention relates to voting and more particularly to mechanisms used to assure a fair counting of the votes.

While there have been some technical problems with recent voting situations, the vast majority of the problems occur with the personnel doing the processing or counting of the ballots. This is often done by misreading the postmark, by "correcting" ballots, and even by creating the ballot out of whole cloth.

Joseph Stalin is reputed to have said that it "isn't who votes that count, it is who counts the vote".

Without a fair count, even the "winning" candidate or proposition cannot be assured that they/it truly won and the chilling affect on the voters when there is a perception of fraud is detrimental to the whole democratic procedure.

It is clear there is a need to provide a more efficient and less susceptible mechanism for the tallying of votes.

SUMMARY OF THE INVENTION

The invention provides for a system for processing or counting tendered ballots. In this context, the tendered ballots are contained within an envelope and are to be "processed" by a polling employee. While the actual procedures vary from locale to locale, generally a posted ballet's postmark is checked to make sure it was mailed within the time frame and sorted based upon that postmark.

The polling employee works from a table on which the ballots are sorted and processed. Within the invention, a camera is directed to the work space on the table. Since the polling employee knows of the camera, there is less temptation to "cut corners" or to improperly interfere with the ballot.

The image from the camera is both digitally stored and simultaneously provided to the poll watchers via a viewing screen. The poll watchers are able to monitor the work being done without physically interfering with the poll worker.

In this context, the invention establishes a table for the work, a camera to monitor the table, a memory for storing the images from the camera, and a remote monitoring system for the poll watcher. The poll watcher, if they notice something questionable, is able to "back up the recording" to view the action again or to use the recording to report a questionable activity by the poll worker.

Those of ordinary skill in the art readily recognize a variety of cameras, viewers, and memories which can be used in this context, including, but not limited to those described in: U.S. Pat. No. 6,992,722, entitled "Closed Circuit Television Camera" issued to Jung on Jan. 31, 2006; U.S. Pat. No. 9,965,919, entitled "Casino Device, Casino Table and Casino Game Room" issued to Oh on May 8, 2018; and U.S. Pat. No. 10,623,703, issued to Pettersen et al. on Apr. 14, 2020; all of which are incorporated hereinto by reference.

As noted earlier, typically the postmark on a submitted ballot must be checked. This portion of the operation is automated as much as possible through the use of a postmark reader. The ballot is positioned so that the reader is directed towards a postmark on a voter envelope. The reader generates data on the postmark and a control mechanism (such as a computer) uses this data to determine if the postmark is valid or not (i.e. filed/mailed within the prescribed time period). This determination provides, via the control mechanism, an indicator for the poll worker as well as the poll watcher. The ballot is then accepted or rejected.

Those of ordinary skill in the art readily recognize a variety of scanning mechanisms which can be used in this context, including, but not limited to those described in: U.S. Pat. No. 9,039,157, entitled "Image Processing Method and Image Processing Apparatus" issued to Ogata et al. on May 26, 2015; U.S. Pat. No. 9,544,473, entitled "Information Processing System and Information Processing Method" issued to Namihira et al. on Jan. 10, 2017; U.S. Pat. No. 10,334,129, entitled "Method of Printing and Scanning" issued to Younis et al. on Jun. 25, 2019; and, U.S. Pat. No. 10,755,811, entitled "Medical Scan Comparison System" issued to Bernard, et al. on Aug. 25, 2020; all of which are incorporated hereinto by reference.

Once the control mechanism determines if the ballot is valid or not (based on the postmark), the poll worker directs the ballot to one of at least two chutes. The two preferred chutes are "accept" or "question". The "question" chute allows the ballot to be hand inspected to assure that the postmark reader provided the correct determination.

To assist the poll worker, a light or other indicator is used to direct the poll worker to place the ballot into the proper chute. In the preferred embodiment, a sensor is also placed in the chutes and the ballot, as it passes through the chute, determines if the poll worker has used the correct chute based on the control mechanism's determination.

Sensing the passage of the ballot is well know in the art and includes, but is not limited to that described in U.S. Pat. No. 8,985,299, entitled "Paper-Type Detection Device and Detection Method" issued to Liao on Mar. 24, 2015, incorporated hereinto by reference.

While the present discussion relates to computers, the invention is not so limited and may include any properly configured control mechanisms.

Control systems and databases are well known to those of ordinary skill in the art, including, but not limited to those described in: U.S. Pat. No. 10,810,684, entitled "system and Method for Data Management and Financial Transaction Categorization" issued to Krakowiecki et al. on Oct. 20, 2020; U.S. Pat. No. 10,824,372, entitled "Data Recovery Method and Device, and Cloud Storage System" issued to Zhang et al. on Nov. 3, 2020; and U.S. Pat. No. 10,826,787, entitled "Method and System that Simulates a Computer-System Aggregation" issued to Soundararajan et al. on Nov. 3, 2020; all of which are incorporated hereinto by reference.

Another aspect of the present invention is the use of a tallying system which uses the sensor above. The number of ballots going through the chutes is compared to the total number of ballets which the poll worker has done; these numbers should match up if there hasn't been any "errors" or deliberate tampering.

Those of ordinary skill in the art readily recognize a variety of mechanisms which keep track of paper, including, but not limited to: U.S. Pat. No. 7,905,448, entitled "Inserter Apparatus, Printer, Print System and Insert Method" issued to Tabuchi on Mar. 15, 2011; U.S. Pat. No. 10,773,533, entitled "Printer" issued to Inokuchi on Sep. 15, 2020; and U.S. Pat. No. 9,070,079, entitled "Printer and Printing System" issued to Iwahara on Jun. 30, 2015; all of which are incorporated hereinto by reference.

Properly received ballots, once removed from the envelope and deposited into the chute, are ideally passed by an automatic reader which scans the ballot and determines what the actual votes are.

Those of ordinary skill in the art readily recognize a variety of reading mechanisms, including, but not limited to those described in: U.S. Pat. No. 7,178,730, entitled "Vote Verification System and Method" issued to Jamison et al. on Feb. 20, 2007; U.S. Pat. No. 7,828,215, entitled "Reader for an Optically Readable Ballot" issued to Chung, et al. on Nov. 9, 2010; and, U.S. Pat. No. 8,556,161, entitled "Electronic Ballot Facility" issued to Djoudi on Oct. 15, 2013; all of which are incorporated hereinto by reference.

Another aspect of this invention is the ability of the controller to access remote data bases for further verification of the submitted ballot. These verification techniques include signatures of the voter which have been stored onto a data base as well as fingerprints.

Those of ordinary skill in the art readily recognize a variety of mechanisms and technology which may be used in the signature recognition use, including, but not limited to those described in: U.S. Pat. No. 9,589,260, entitled "System and Method for Authenticating Electronic Money using a Smart Card and a Communication Terminal" issued to Choi on Mar. 7, 2017; and, U.S. Pat. No. 10,353,495, entitled "Personalized Operation of a Mobile Device using Sensor Signatures" issued to Nemala et al. on Jul. 16, 2019; all of which are incorporated hereinto by reference.

If the signatures do not match, then the ballots are again sorted into and authorized bin and a "further investigation" bin. All of this is done ideally before the ballots are read and counted.

In some situations, a fingerprint is also used to identify the voter. This may be a pre-inked section of the ballot into which the voter presses their finger.

Those of ordinary skill in the art recognize a variety of mechanisms which might be used in this context for fingerprint recognition, including, but not limited to those described in: U.S. Pat. No. 10,817,698, entitled "Touch Display Panel with Fingerprint Recognition Device" issued to Shi on Oct. 27, 2020; U.S. Pat. No. 10,824,855, entitled "Image Data Extraction for Transaction Management" issued to Sachtleben et al. on Nov. 3, 2020; and, U.S. Pat. No. 10,825,048, entitled "Image Processing Methods" issued to Mazur et al. on Nov. 3, 2020; all of which are incorporated hereinto by reference.

As with the signature check, those ballots whose fingerprint fails the check will be placed into a separate bin which will require human interaction.

The use of fingerprints is also useful, not only for verification check on the ballot counting, but also is useful for enforcement against forgers. During the vote tally as outlined above, all of the fingerprints are recorded and the fingerprints are checked (either at the time or subsequently) to see if there are any duplicate (or triplicate etc.) prints. These duplicate prints identify with certainty those who have altered or "monkeyed with" ballots so that they can be arrested and prosecuted.

The invention, together with various embodiments thereof, will be illustrated by the accompanying drawings and the following description.

DRAWINGS IN BRIEF

DRAWINGS IN DETAIL

Figure 1:
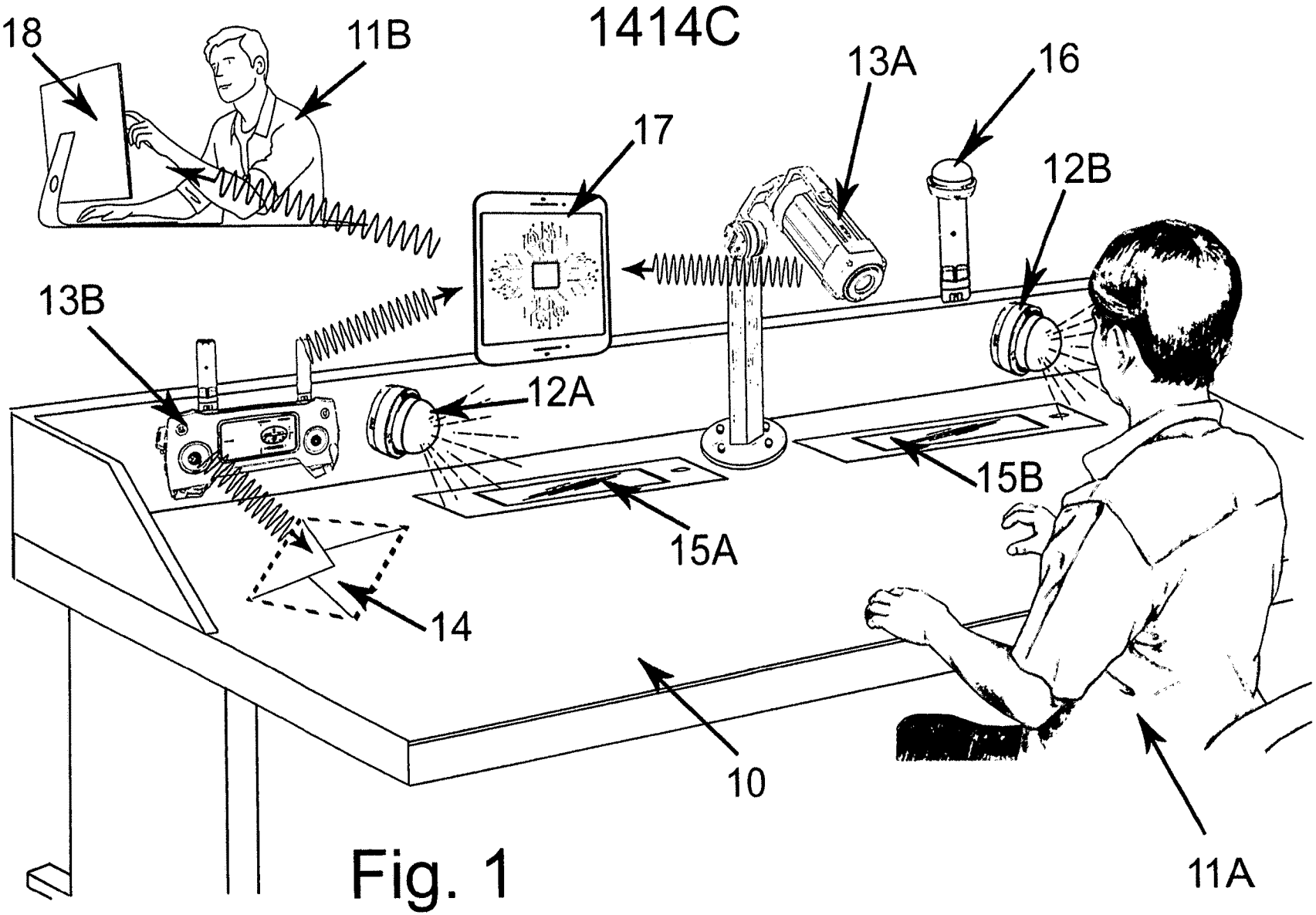
FIG. 1 is a perspective view of the preferred embodiment.

FIG. 1 is a perspective view of the preferred embodiment.

Table 10 is arranged so that poll worker 11A is able to scan and sort through the submitted ballots. Lights 12A and 12B illuminate the surface of table 10 with camera 13A being directed towards the surface of table 10. The image from cameral 13A is fed to control/recording mechanism 17; the image is also shared with screen 18 which is monitored by poll monitor 11B. In this manner, the activities of poll worker 11A are recorded and monitored to assure full compliance with the voting law.

Poll worker 11A first places envelope 14 under postmark reader 13B and the image is sent to control/recording mechanism 17 which determines if the postmark on the envelope 14 is acceptable or not. Control/recording mechanism 17 makes a determination and directs the poll work 11A to place the ballot (which was enclosed within envelope 14) into the appropriate chute 15A or 15B in this illustration.

Identifying the appropriate chute 15A or 15B for the poll worker is done by either illuminating the proper chute 15A or 15B or by opening a door to the chosen chute.

If an error occurs, the flashing light 16 is illuminated by control/recording mechanism.

Figure 2:
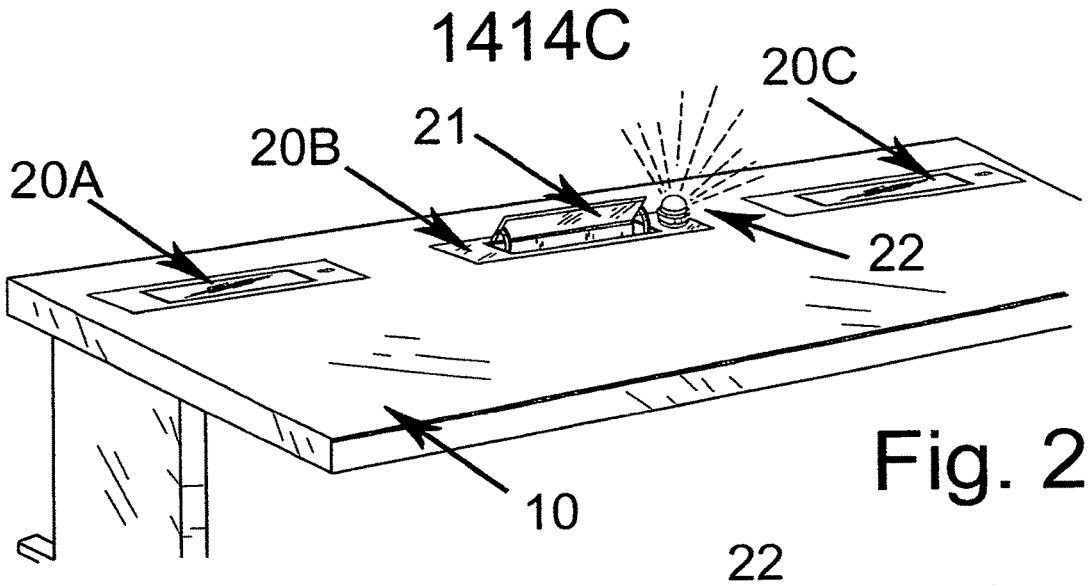
FIG. 2 illustrates the preferred chute arrangements for the polling table.

FIG. 2 illustrates the preferred chute arrangements for the polling table.

In this illustration, there are three chutes 20A, 20B, and 20C located on table 10 and which are accessible for the poll worker (not shown). In this embodiment, doors are closed over all of the chutes and only are opened by the control/recording mechanism (not shown). In this illustration, door 21 for chute 20B has been opened and light 22 is illuminated. In this way, the poll worker knows exactly where the ballot (now separated from the envelope) should be placed for proper processing.

Figure 3:
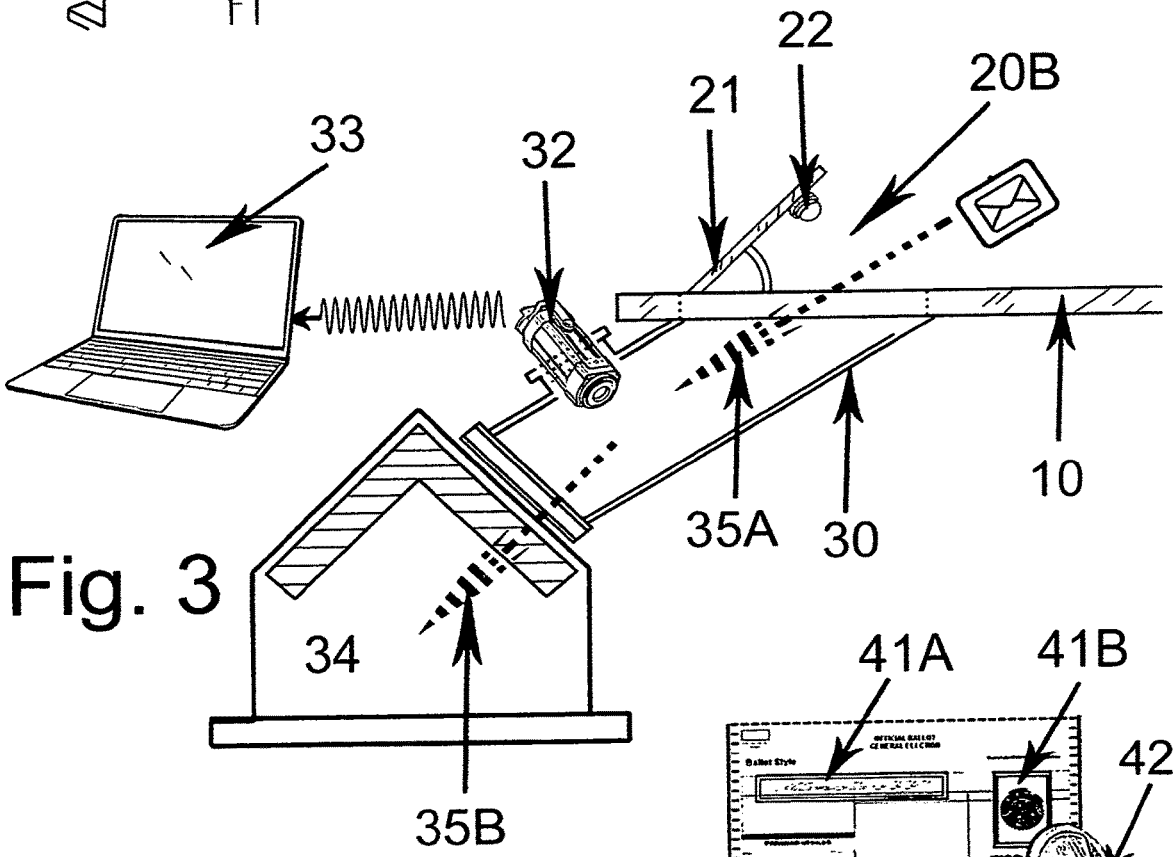
FIG. 3 illustrates the movement of a ballot after it has been put into the "accept" chute.

FIG. 3 illustrates the movement of a ballot after it has been put into the "accept" chute.

Chute 20B has door 21 opened and light 22 illuminated to direct the poll worker (not shown) to place the ballot into the chute 20B as illustrated by arrow 35A. The ballot travels down the chute slide 30 and is counted via sensor 32.

The ballot is received and processed by ballot reader 32 which also records that data from sensor 32. Only when sensor 32 is activated, will door 21 close and then the next ballot will be processed.

Ballot reader 32 reads the ballot and deposits the completed ballot into bin 34. In another embodiment, a second bin is also used to receive ballots which ballot reader 32 is not able to properly read. These ballots then must be processed by hand.

The output from the ballot reader 32 is communicated to the tally computer which keeps tally of the votes being rendered (both accepted and rejected/questioned).

Figure 4:
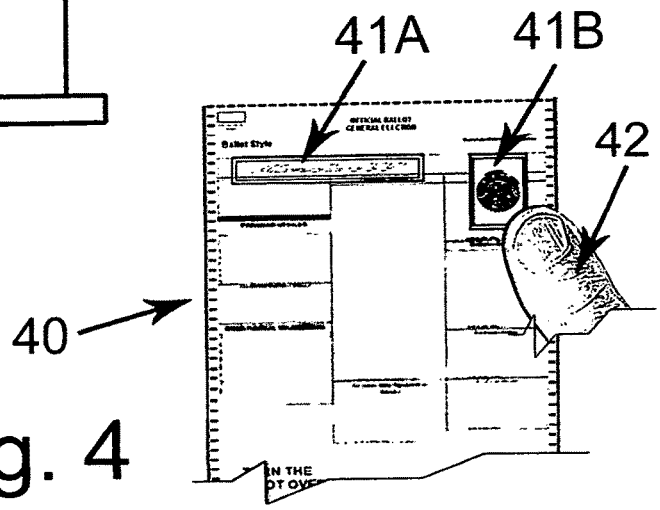
FIG. 4 illustrates a ballot which uses a signature and a fingerprint for identification.

FIG. 4 illustrates a ballot which uses a signature and a fingerprint for identification.

Ballot 40, in this illustration, has both a signature box 41A as well as place 41B for receiving a fingerprint from voter 42. Both are optionally checked for authenticity of the ballot.

It is clear that the present invention provides for a ballot authentication and counting mechanism which is able to assure a more honest election.

What is claimed is:

1. A system for processing tendered ballots comprising:

a) a table for a worker, said table having a work space for sorting the tendered ballots;

b) a camera being directed to the work space on the table, said camera generating data indicative of an image of the work space;

a memory storing the data indicative of the work space image;

d) a remote poll observer display, said remote poll observer display receiving the data indicative of the work space image and displaying an image based upon the data indicative of the work space image;

e) a postmark reader directed towards a postmark on a voter envelope and generating postmark data;

f) a control mechanism receiving the postmark data from the reader and generating a validity indicator therefrom, said validity indicator for acceptance or rejection of the ballot based upon the postmark data;

g) wherein the table for a worker includes at least two chutes configured to receive a ballot, each chute having a light associated thereto; and, h) wherein the control mechanism activates a light for one of the at least two chutes based upon the validity indicator.

2. The system for processing tendered ballots according to claim 1, a) wherein each chute includes a chute door selectively baring access to the chute; and, b) wherein the control mechanism opens a selected chute door based on the validity indicator.

3. The system for processing tendered ballots according to claim 2, a) wherein each chute includes a sensor, each sensor generating a use indicia indicating that a ballot has passed through the respective chute; and, b) wherein the control mechanism renders the postmark reader inoperative until receipt of the use indicia from either chute.

4. The system for processing tendered ballots according to claim 3, further including a tally mechanism activated by the use indicia generating a total processed indicia.

5. The system for processing tendered ballots according to claim 1, further including a reading mechanism communicating with one of the at least two chutes, said reading mechanism scanning a ballot and generating voting data therefrom.

6. The system for processing tendered ballots according to claim 5, a) further including a signature data base containing signature data of voters;

b) wherein the control mechanism withdraws a specific signature data of a voter from the signature data base, and, based on signature data from the reading mechanism and the specific signature data, generates a signature acceptance/rejection indicia.

7. The system for processing tendered ballots according to claim 6, a) further including a first and second bin; and, b) wherein the control mechanism directs the ballot to a selected one of the first and second bin based upon the signature acceptance/rejection indicia.

8. The system for processing tendered ballots according to claim 5, a) further including a fingerprint data base containing fingerprint data of voters; and, b) wherein the control mechanism withdraws a specific fingerprint data of a voter from the fingerprint data base, and, based upon signature data from the reading mechanism and the specific fingerprint data, generates a fingerprint acceptance/rejection indicia.

9. The system for processing tendered ballots according to claim 8, a) further including a first and second bin; and, b) wherein the control means directs the ballot to a selected one of the first and second bin based upon the fingerprint acceptance/rejection indicia.

10. A system for processing tendered ballots comprising:

a) a table for a worker, said table having a work space for sorting the tendered ballots, said table having at least two chutes therein;

b) a camera being directed to the work space on the table, said camera generating data indicative of an image of the work space;

c) a reading mechanism communicating with one of the at least two chutes, said reading mechanism scanning a ballot and generating actual signature data therefrom;

d) a signature data base containing signature data of voters; and, e) a control mechanism, wherein, based upon a specific signature data of a voter from the signature data base, and, based on signature data from the reading mechanism and the specific signature data, generates a signature acceptance/rejection indicia.

11. The system for processing tendered ballots according to claim 10, a) further including a first and second bin; and, b) A control mechanism, said control mechanism directs the ballot to a selected one of the first and second bin based upon the signature acceptance/rejection indicia.

* * * * *